US006623154B1

(12) United States Patent
Garcia

(10) Patent No.: US 6,623,154 B1
(45) Date of Patent: Sep. 23, 2003

(54) DIFFERENTIAL INJECTOR

(75) Inventor: Paul Garcia, Las Vegas, NV (US)

(73) Assignee: Premier Wastewater International, Inc., Las Vegas, NV (US)

( * ) Notice: Subject to any disclaimer, the term of this patent is extended or adjusted under 35 U.S.C. 154(b) by 0 days.

(21) Appl. No.: 09/547,447

(22) Filed: Apr. 12, 2000

(51) Int. Cl.[7] ..... B01F 5/04
(52) U.S. Cl. ..... 366/163.2; 137/888
(58) Field of Search ..... 366/162.1, 163.1, 366/163.2, 167.1, 173.1, 173.2; 137/888–890, 896

(56) References Cited

U.S. PATENT DOCUMENTS

| | | | | |
|---|---|---|---|---|
| 398,456 | A | | 2/1889 | Secor |
| 812,232 | A | * | 2/1906 | Rhodes |
| 1,925,787 | A | * | 9/1933 | Brooks |
| 2,361,150 | A | | 10/1944 | Petroe |
| 2,424,654 | A | | 7/1947 | Gamble |
| 2,504,678 | A | * | 4/1950 | Gardner |
| 2,563,002 | A | | 8/1951 | Bissell et al. |
| 2,857,202 | A | | 10/1958 | Snyder |
| 2,881,800 | A | * | 4/1959 | Bauerlein |
| 3,123,285 | A | * | 3/1964 | Lee |
| 3,257,180 | A | | 6/1966 | King |
| 3,271,304 | A | | 9/1966 | Valdespino et al. |
| 3,473,787 | A | * | 10/1969 | Bartlett |
| 3,502,103 | A | | 3/1970 | Verschuur |
| 3,507,626 | A | | 4/1970 | Van Horn |
| 3,547,409 | A | * | 12/1970 | Jacuzzi |
| 3,768,962 | A | | 10/1973 | Baranowski, Jr. |
| 3,799,195 | A | * | 3/1974 | Hermans |
| 3,826,279 | A | | 7/1974 | Verschuur |
| 3,993,097 | A | | 11/1976 | Verschuur |
| 4,123,800 | A | | 10/1978 | Mazzei |
| 4,210,166 | A | | 7/1980 | Munie |
| 4,210,534 | A | | 7/1980 | Molvar |
| 4,320,541 | A | * | 3/1982 | Neenan |
| 4,333,833 | A | | 6/1982 | Longley et al. |
| 4,344,752 | A | | 8/1982 | Gallagher |
| 4,474,477 | A | * | 10/1984 | Smith et al. |
| 4,617,861 | A | | 10/1986 | Armstrong |
| 4,664,147 | A | | 5/1987 | Maddock |
| 4,673,006 | A | * | 6/1987 | Speck |
| 4,721,126 | A | * | 1/1988 | Horii |
| 4,761,077 | A | | 8/1988 | Werner |
| 4,765,373 | A | | 8/1988 | Munroe |
| 5,222,525 | A | * | 6/1993 | Munroe |
| 5,300,022 | A | | 4/1994 | Klapper et al. |
| 5,338,113 | A | * | 8/1994 | Fissenko |
| 5,452,955 | A | | 9/1995 | Lundstrom |
| 5,492,654 | A | * | 2/1996 | Kozjuk et al. |
| 5,693,226 | A | | 12/1997 | Kool |
| 5,758,691 | A | | 6/1998 | Nedderman, Jr. |
| 5,762,416 | A | | 6/1998 | LeSire |

(List continued on next page.)

FOREIGN PATENT DOCUMENTS

| | | | | |
|---|---|---|---|---|
| CH | 674160 | * | 5/1990 | |
| DE | 296 17 621 U | | 8/1997 | |
| FR | 2 201 121 A | | 4/1974 | |
| GB | 802691 | | 10/1958 | |
| GB | 870525 | | 6/1961 | |
| GB | 1320746 | | 6/1973 | |
| GB | 2263649 | * | 8/1993 | |
| JP | 2000-213681 | * | 8/2000 | |
| SU | 1308370 | * | 5/1987 | ..... 366/163.2 |

*Primary Examiner*—Charles E. Cooley
(74) *Attorney, Agent, or Firm*—Frishauf, Holtz, Goodman & Chick, P.C.

(57) ABSTRACT

A differential injector for fluid mixing having a primary fluid inlet, a throat section and a diverging discharge outlet. A secondary fluid is pulled into the discharge outlet, through annular recessed grooves, by suction action produced by the primary fluid of the venturi. A plurality of channels feed the secondary fluid into the recessed annular grooves. The channels may be connected to a secondary fluid injection port via an injection annulus.

57 Claims, 11 Drawing Sheets

U.S. PATENT DOCUMENTS

| | | | | |
|---|---|---|---|---|
| 5,796,798 | A | | 8/1998 | Aujollet |
| 5,857,773 | A | | 1/1999 | Tammelin |
| 5,893,641 | A | | 4/1999 | Garcia |
| 5,931,579 | A | * | 8/1999 | Gallus et al. |
| 5,951,922 | A | | 9/1999 | Mazzei |
| 5,974,338 | A | | 10/1999 | Asano et al. |
| 5,983,193 | A | | 11/1999 | Heinonen et al. |
| 6,012,492 | A | * | 1/2000 | Kozyuk |
| 6,170,978 | B1 | * | 1/2001 | Short |
| 6,453,926 | B1 | * | 9/2002 | Baker |
| 6,523,991 | B1 | * | 2/2003 | Maklad |

* cited by examiner

DIFFERENTIAL INJECTOR

BACKGROUND OF THE INVENTION

1. Field of the Invention

The present invention relates generally to a fluid mixing and/or an aerating apparatus. The invention also relates to a venturi-type or suction-type fluid mixing and/or aerating device, and also to a device for causing a first fluid to dissolve a second fluid therein to its saturation state or substantially to its saturation state.

2. Description of the Related Art

A variety of fluid mixing devices have been devised wherein a venturi is adapted with different types of mechanical injectors. Fluid flow through pipes and other flow devices have associated losses inherent to the device, depending on the type of material the flow channel or device is composed of, and the manufacturing method used to produce the fluid flow device. Also, depending on the physical features of the channels (i.e. surface texture, roughness, etc.) or the surfaces on which a fluid traverses, pressure head losses in the flow results.

These losses within a flow device such as a venturi driven flow system vary from device to device, depending on the mechanical element adapted thereto. For example, losses associated with mechanical elements such as check valves, mechanical injectors, blowers, compressors, pumps, etc. during the injection of liquid, air or other elements within the primary flow of fluids through the flow device serve to minimize fluid flow and increase the pressure differential.

Generally, the principal goal for maintaining fluid flow within a network of interconnected flow channels or elements, according to first principles in mechanics of fluids, is to minimize total pressure head losses associated with the respective mechanical elements. Most of the conventional fluid flow devices have failed to reduce the total head losses as herein described by the instant invention. Without significantly reducing the pressure head losses associated with the mechanical elements as recited above, a significant drop in the volume flow rate occurs within most flow devices. This directly affects the mixing of multiple fluids within the primary fluid channel or stream of typical fluid flow devices.

For example, U.S. Pat. No. 2,361,150 issued Petroe discloses a method and apparatus for admitting chlorine to a stream of pulp stock via a plurality of injectors or nozzles during the effluent stage. The mechanical injectors are peripherally disposed within the flow stream or path having a direct contribution to the total head loss unlike the differential injector as herein described.

U.S. Pat. No. 2,424,654 issued to-Gamble discloses a fluid mixing device which also suffers from head losses as recited above. A venturi flow device having an adjustable throat section includes baffles disposed directly in the flow path or throat (i.e. in-line injectors) of the device which contributes to the total head loss as similarly taught by the patent of Gamble. Other varieties of in-line injectors are those taught by King (U.S. Pat. No. 3,257,180), Van Horn (U.S. Pat. No. 3,507,626), Baranowski, Jr. (U.S. Pat. No. 3,768,962) and Longley et al. (U.S. Pat. No. 4,333,833).

U.S. Patents issued to Secor (U.S. Pat. No. 398,456), and Mazzei (U.S. Pat. No. 4,123,800) disclose a venturi flow device comprising a mixer injector disposed at the throat section of the device. The patent of Mazzei in particular comprises a plurality of port means which are angularly spaced-apart around the throat section and interconnect an annular chamber disposed within an inside wall of the throat portion. This particular design is similar to that of the instant invention in that, it attempts to minimize a pressure drop within the channel. The injector of Mazzei, however, fails to reduce losses at the throat section unlike that of the instant invention as herein described.

U.S. Pat. No. 5,693,226 issued to Kool discloses an apparatus for demonstrating a residential point of use water treatment system wherein an injection port or suction branch injects a contaminate material in a direction perpendicular to the flow stream via hoses adapted thereto. The differential injector according to the instant invention is different in that the injections are made in a direction parallel to the flow stream which significantly reduces head losses attributed to the different al injector as herein described.

U.S. and Foreign Patents by Monroe (U.S. Pat. No. 4,765,373), Luft et al. (AU 203339), Gretton-Lowe (GB 802,691), Hollins (GB 870,525) and Evans (GB 132074) disclose flow devices generally relevant to that of the instant invention.

The difference between the instant invention and the related art is that the differential injector according to the instant invention provides mixing and/or aeration without the additional need of mechanical injectors which increase the pressure head losses in the primary flow stream. Mixing or aeration occurs by injection in the general flow direction of a main flow stream with very low losses compared to conventional flow devices.

In this regard, none of the above inventions and patents, taken either singularly or in combination, is seen to describe the instant invention as claimed. Thus a differential injector solving the aforementioned problems is desired.

SUMMARY OF THE INVENTION

The injector according to-the instant invention is a fluid mixing and/or aerating device having a primary fluid inlet. Some embodiments also include a constricting primary fluid inlet and an elongated throat section to increase the velocity of the primary fluid flow. A secondary fluid is pulled into the forward portion of a discharge outlet, through at least one channel which is recessed in the wall of the device, by suction action produced by the primary fluid as it passes out of the inlet section to an enlarged-size, pressure releasing, discharge section. One or a plurality of ports feeds the secondary fluid into the at least one recessed channel. The secondary fluid ports are connected to a secondary fluid injection port or are open to the atmosphere.

After the discharge section, the mixed fluids can be passed through an elongated conduit section to cause the secondary fluid to become more dissolved in the primary fluid, up to its saturation state.

Accordingly, it is a principal object of the invention to provide a differential injector for reducing total head loss in a flow device by injection.

It is another object of the invention to provide a is differential injector which mixes fluids and/or aerates fluids with a minimum number of attached mechanical elements.

It is yet another object of the invention to provide apparatus for mixing primary and secondary fluids such that the secondary fluid is dissolved in the primary fluid up to its saturation state.

It is a further object of the invention to provide a differential injector which is easily assembled and disassembled for inspection, cleaning or repair.

It is still another object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIGS. 9A–9F are schematic views of the different arrangements of devices according to the present invention.

DETAILED DESCRIPTION OF THE PREFERRED EMBODIMENTS

The present invention is directed to a differential injector which produces mixing and/or aeration in a flow device with virtually zero or very low losses by injection. Two embodiments of the present invention are depicted in FIGS. 3–5 and are generally referenced by numeral 20.

One object of the instant invention is to produce fluid injections of one or more fluid elements within a venturi-type flow device having virtually zero losses via the method of injection. The differential injector according to the instant invention is applicable to various applications such as an aeration device for water and waste treatment plants, waste treatment systems, pools, jacuzzies, a mixing device for paints, chemicals or injectors for dyes and chemicals, etc., agitation device for water treatment plants and oil separation plants, etc.

Figure 1:
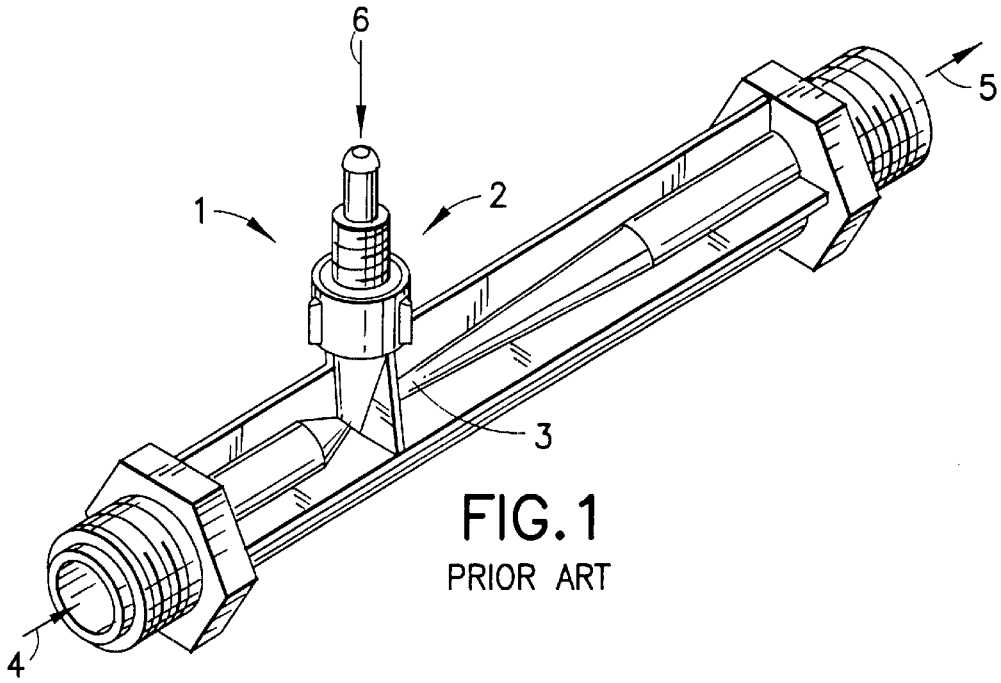
FIG. 1 PRIOR ART
FIG. 1 is a perspective view of a prior art, conventional venturi flow device.
Figure 2:
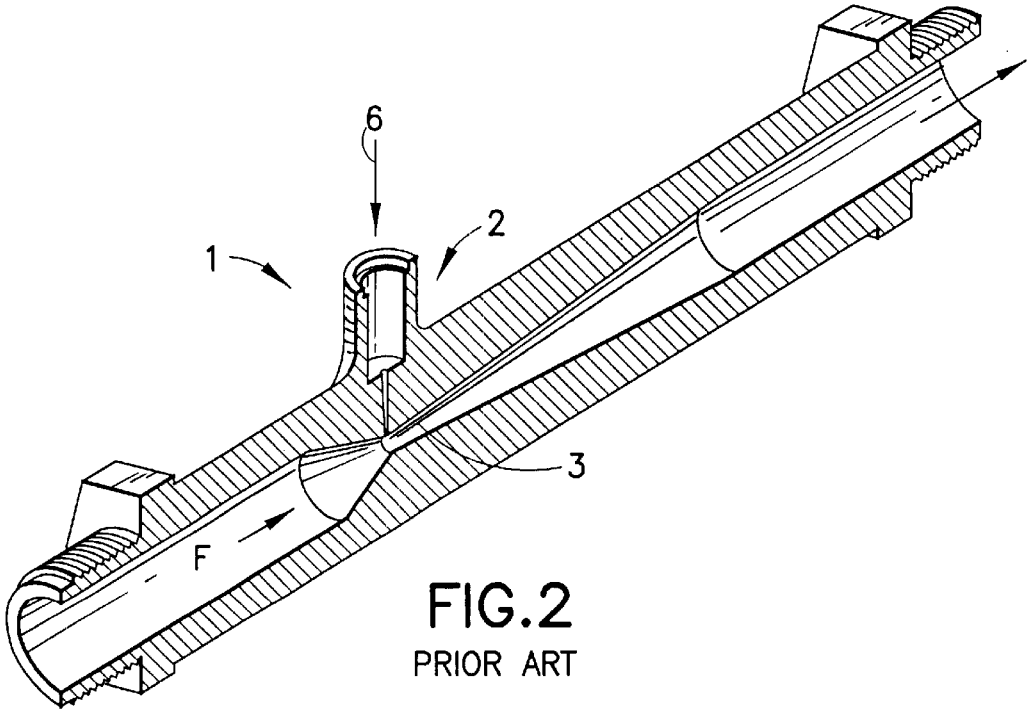
FIG. 2 PRIOR ART
FIG. 2 is a cross-sectional perspective view of the prior art, conventional venturi flow device in FIG. 1.

Conventional flow devices provide mixing via a flow device as diagrammatically illustrated in FIGS. 1 and 2. As seen in these figures, a venturi driven flow device 1 has a fluid injection means 2 disposed at the throat 3 of the venturi 1. A fluid flow entrance (influent) 4 and exit (effluent) 5 provide the primary flow path F for the device 1. A secondary fluid flow path 6 is provided by the injector 2. The secondary fluid flow 6 is injected directly into the primary flow stream in a direction perpendicular thereto. This type of injection introduces a pressure differential (or associated loss) within the flow stream which decreases the degree of uniform mixing between the primary and secondary fluid in the conventional flow device.

Figure 3:
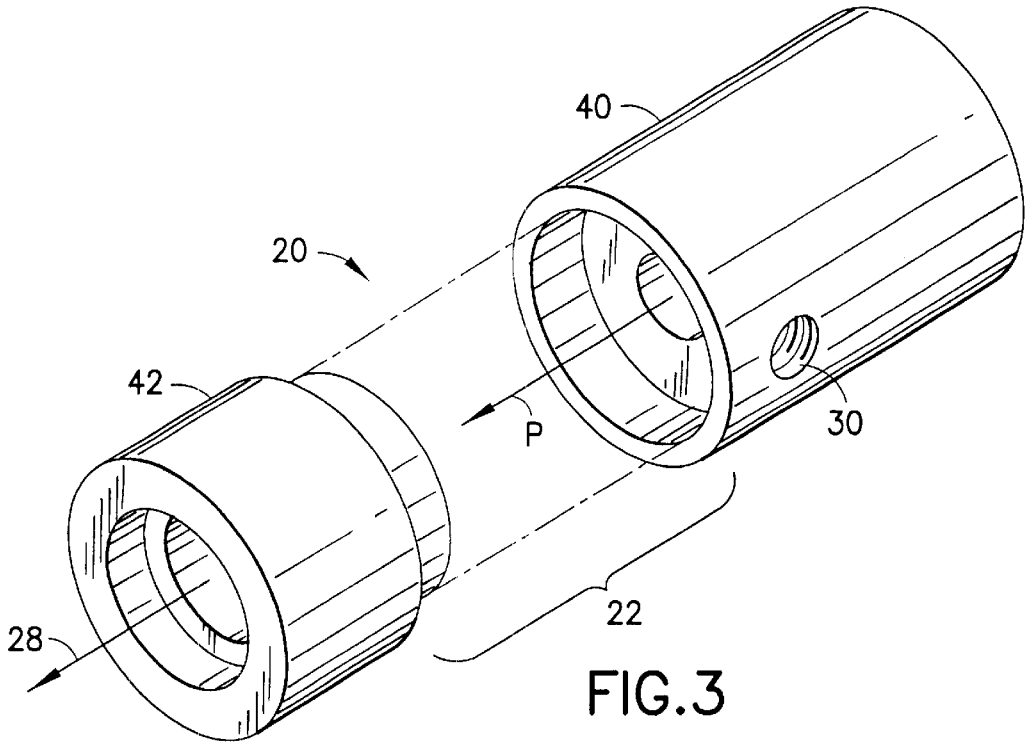
FIG. 3. is an exploded perspective view of the differential injector according to the present invention.
Figure 4:
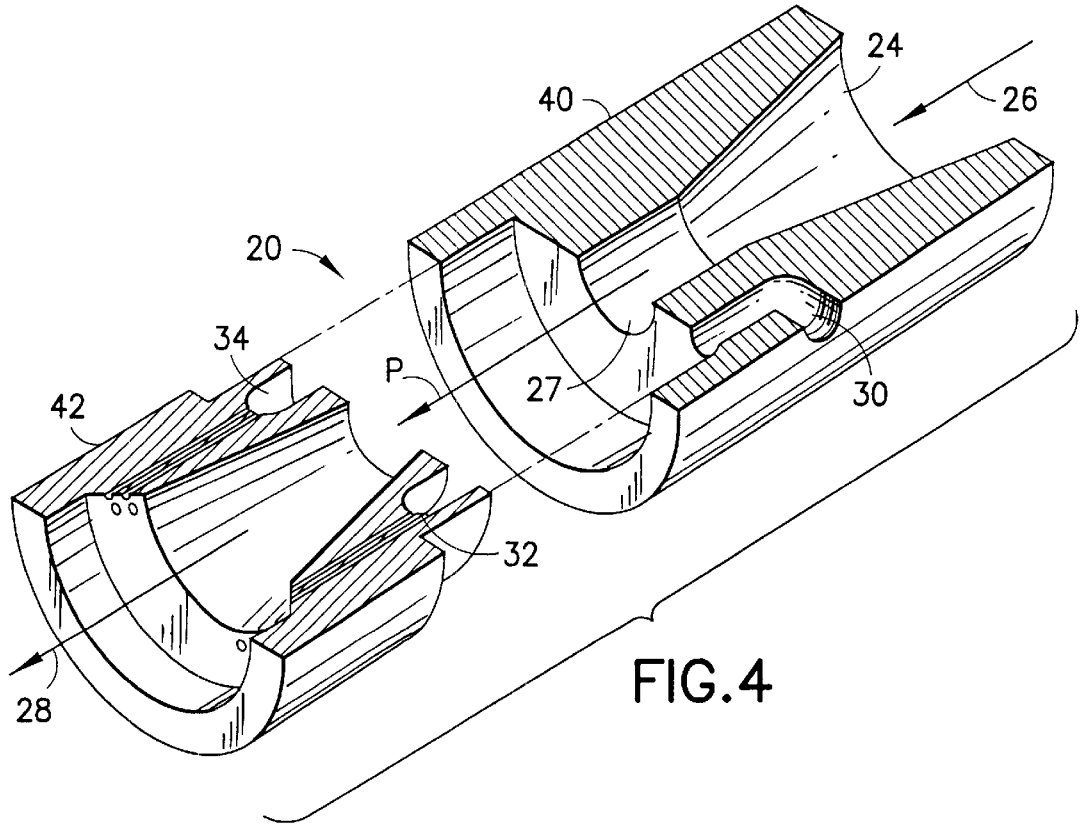
FIG. 4 is an exploded cross-sectional view of the differential injector according to FIG. 3, illustrating a plurality of injection channels for injecting fluid within the flow device for mixing.
Figure 5:
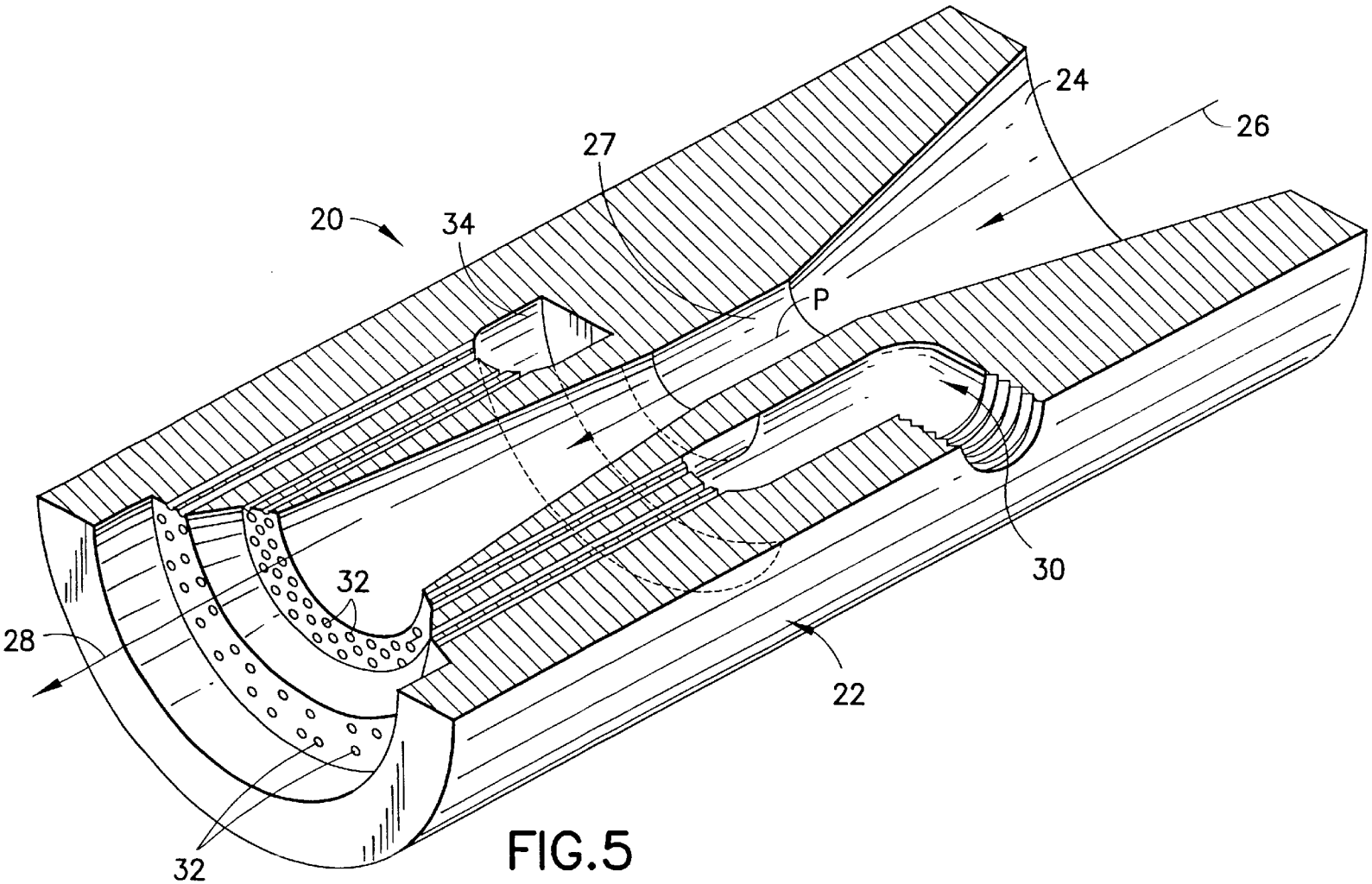
FIG. 5 is a cross-sectional view of the differential injector of the invention according to an alternate embodiment, illustrating a plurality of channels coupled by a annular cavity for injecting fluid within the flow device for mixing.

As best seen in FIGS. 3 and 4, the differential injector 20 according to one preferred embodiment comprises a substantially cylindrical fluid flow body 22 having a venturi 24 disposed therein. The venturi 24 is disposed and aligned concentric with the body 22 for providing primary fluid flow P through the venturi 24. The venturi 24 has an inlet port 26 or the influent portion of the primary flow and an outlet port 28 in the discharge section. The inlet port converges at a throat section 27 of the venturi 24 and diverges at the outlet port 28 or effluent portion of the primary flow. A primary fluid such as water enters the differential injector 20 for mixing or aeration. Depending upon the area of application, a secondary fluid comprising various chemicals or fluids (including a gas or gases, such as, for example, air) as recited above are adapted to the injector 20 for mixing without injection directly within the throat 27 of the venturi 24. It would be obvious to the skilled artisan to provide the appropriate adaptor for injecting fluids as a matter of intended use.

Accordingly, a secondary fluid or injector port 30 is provided for supplying a plurality of fluids for mixing with the primary fluid P or for aeration of the primary fluid P. The injector port 30, as diagrammatically illustrated in FIG. 3, is disposed within a first wall portion 40 of the substantially cylindrical fluid flow body 22. A cross-sectional view of FIG. 3, as shown in FIG. 4, further illustrates the arrangement of a plurality of channels 32 disposed within a second wall portion 42 of the body 22 for delivering a secondary fluid downstream from the throat 27, of the venturi 24 and are generally axially aligned (that is, the channels are not helically twisted). This arrangement is significant in that the secondary fluid is injected with substantially zero resistance (or very low resistance) with respect to the primary flow direction. This point of injection translates into reduced head loss within the differential injector 20. The channels 32 need not be parallel to the venturi. Other orientations are possible and are contemplated. See, for example, the embodiments of FIGS. 6–8.

According to an alternate embodiment as diagrammatically illustrated in FIG. 5, the differential injector 20 is shown as a single unit further comprising an annular cavity 34 in fluid communication with the secondary fluid injector port 30 and a plurality of channels 32 peripherally arranged and concentric with the venturi 24, for improving the secondary to primary fluid mixing ratio by volume. The channels 32 may or may not be parallel to the venturi 24.

Some advantages of the differential injector 20 according to the embodiments of FIGS. 3–5 are that it is made of a composite plastic material which is easily machined or otherwise fabricated to the desired dimensions. Also, the two-part injector 20 of FIGS. 3 and 4, made of this material, can be easily removed and disassembled, as illustrated in FIGS. 3 and 4, for inspection and/or replacement and/or repair while in actual use. Other machinable materials could also be used, such as aluminum, stainless steel, etc. The materials used for all of the devices of the present invention should preferably be compatible with the fluids passing through the device, and should be easily machinable for ease of production.

Other non-obvious advantages of the differential injector 20 of FIGS. 3–5 are achieved through the design by reducing the inlet diameter rate by about ½ in the inlet section 24 and holding that reduced diameter in the throat section 27 for a distance in length equal to about 2.5 times the diameter of the throat section 27. At the exit of the throat section 27, the diameter is expanded in the discharge section (near the outlet port 28), for example to the inlet diameter, within a length equal to about ½ the length of the inlet or influent section, thus causing a build-up of pressure during travel of the influent through the inlet section 24, with an instant release in the end of the throat section 27. Torroidal vortexes and turbulence are created in the expanding flow, reduced pressure primary fluid, which adds to the suction effect and promotes mixing. The secondary fluid grooves or channels 32 are connected to an injection port through an injection annulus that has a volume capacity equal to several times the cumulative capacity that the channels 32 can carry.

Figure 6:
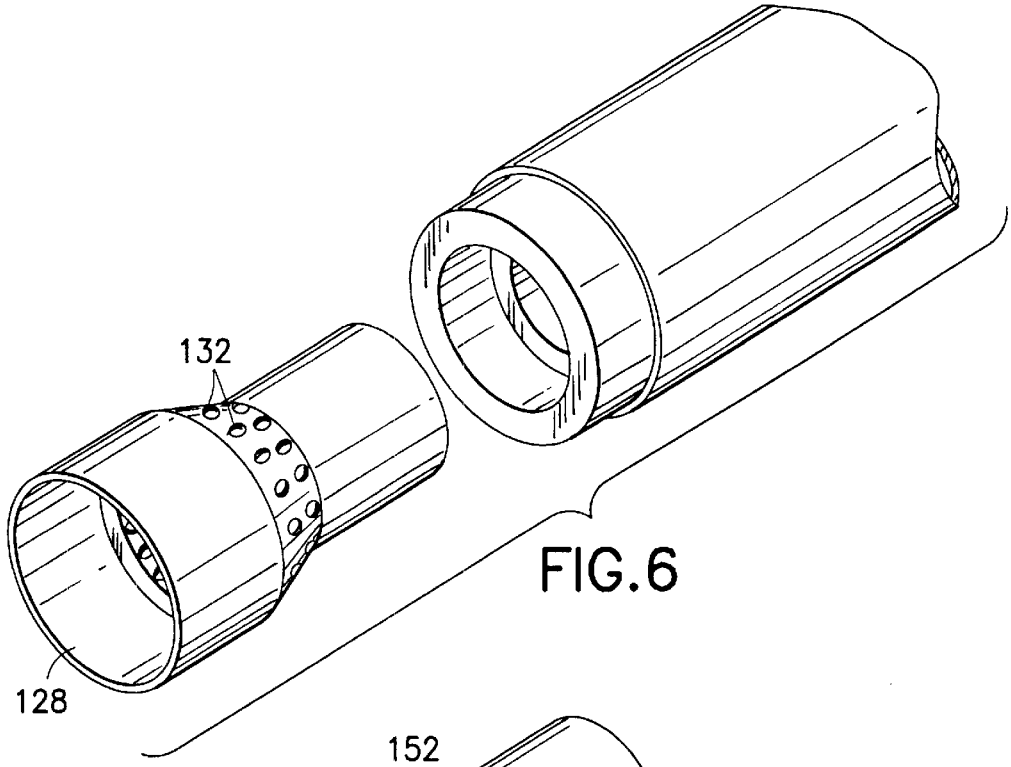
FIG. 6 is an exploded perspective view of another embodiment of a differential injector according to the present invention.
Figure 7:
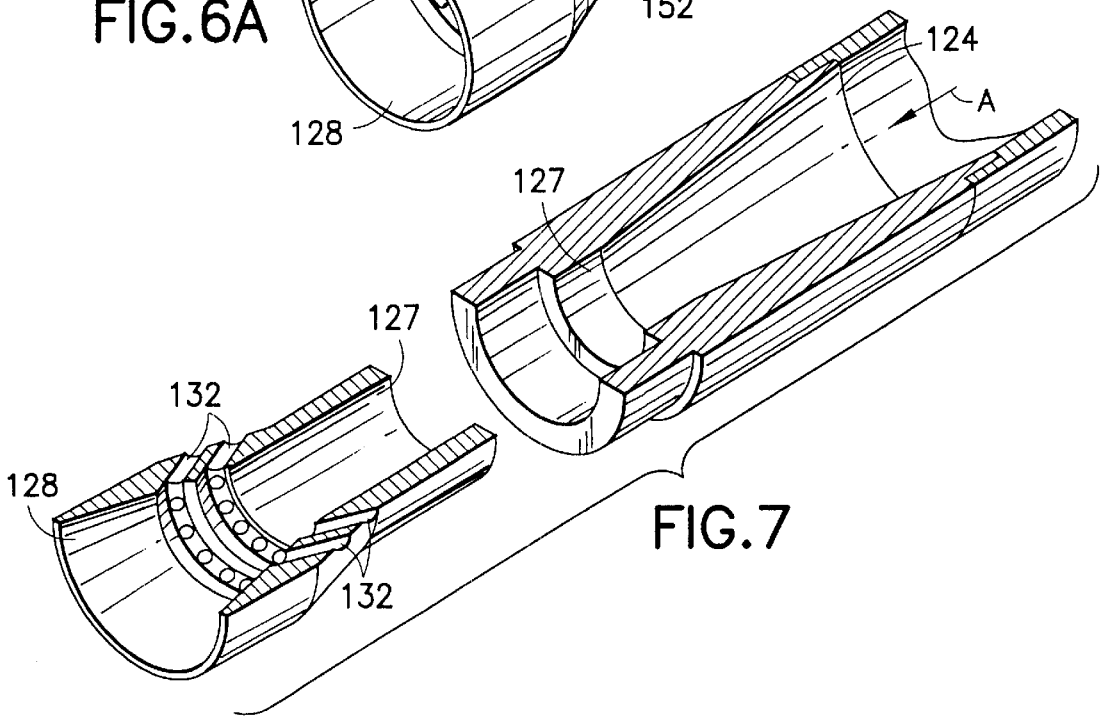
FIG. 7 is an exploded cross-sectional view of a differential injector of FIG. 6.
Figure 8:
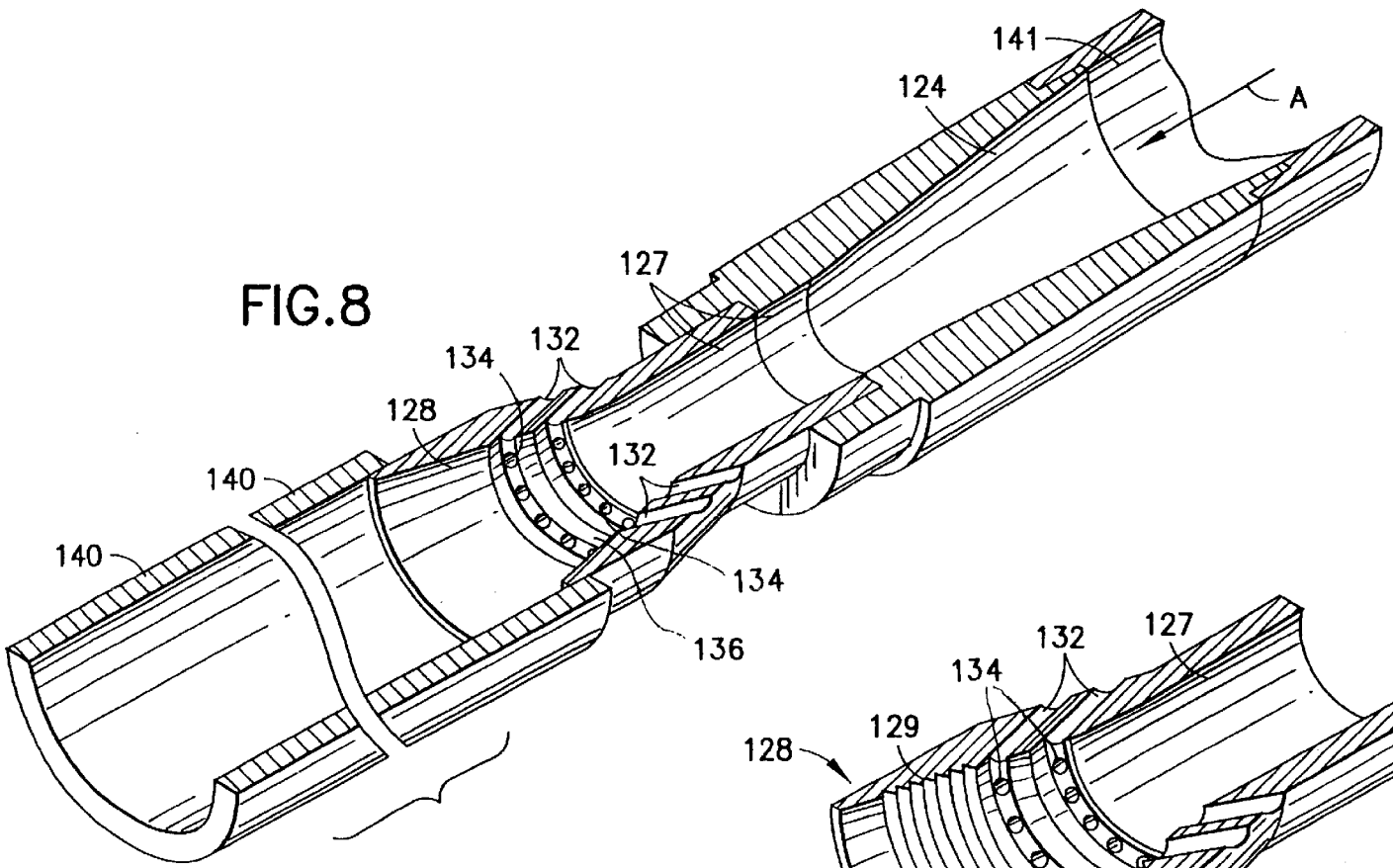
FIG. 8 is an exploded cross-sectional view of the embodiment of FIGS. 6 and 7, in its assembled state.

FIGS. 6–7 show another embodiment of the invention which is similar to the embodiment of FIGS. 3 and 4, but wherein the secondary fluid channels 132 are open to the atmosphere on their inlet side (i.e., at the outside of the device) and are not parallel to the direction of primary fluid flow (direction of arrow A in FIG. 7). FIG. 8 shows the embodiment of FIGS. 6 and 7. in assembled form, and connected to an output conduit 140 which will be described later.

Figure 8A:
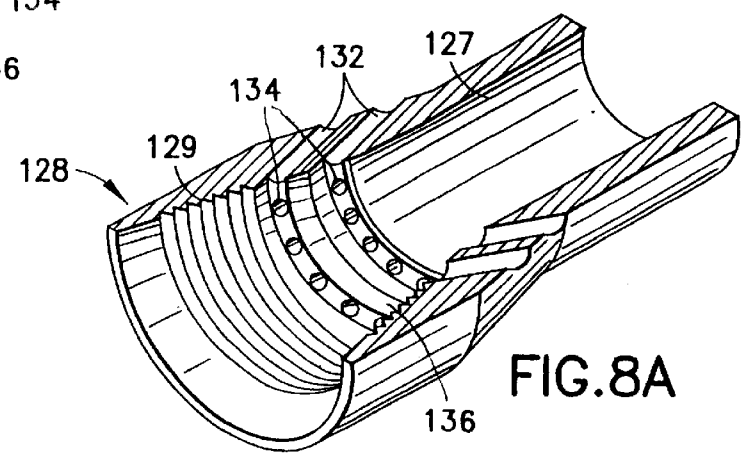
FIG. 8A is a partial exploded cross-sectional view of the embodiment of FIGS. 6–8, but with a modified discharge section.

The embodiment of FIGS. 6–8 includes a converging primary entry section 124 which is similar to entry section 24 in FIGS. 3 and 4. A throat section 127 is provided similar to that of FIGS. 3 and 4, and a diverging exit or discharge section 128 is provided similar to that of FIGS. 3 and 4. As mentioned above, the secondary fluid channels 132 in FIGS. 6 and 7 are not parallel to the primary fluid flow, but are angulated slightly (i.e., by about 20 degrees) with respect thereto. It has been found that angles of up to about 30 degrees relative to the direction of primary fluid flow are satisfactory and provide desired results. Secondary fluid channels arranged at an angle of up to about 30 degrees are considered to be substantially in the same direction as the direction of primary fluid flow. As shown in FIGS. 7, 8 and 8A, the secondary fluid channels 132 terminate at outlet ports 134 which are annularly disposed. The first (inner) and second (outer) secondary fluid channels have an interior surface segment 136 of the interior surface of the flow channel disposed therebetween. The interior surface segment includes at least one surface irregularity (for example a step) to increase turbulence and the production of torroidal vortices to improve mixing of, and the resulting actions upon, the primary fluid and secondary fluid similar to that described below in connection with grooves 129 shown in FIG. 8A. FIG. 5 shows Structure similar to that discussed above in connection with FIGS. 8 and 8A.

Figure 6A:
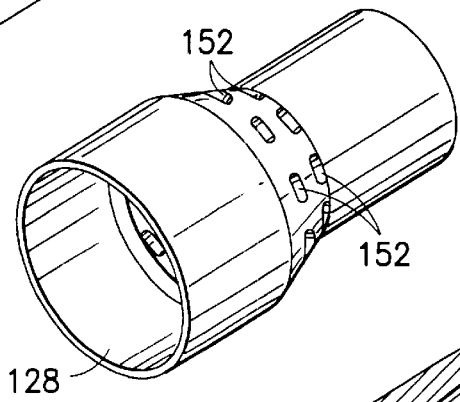
FIG. 6A is a partial exploded view of a modification of the embodiment of FIG. 6.

The number of secondary fluid channels 132 is shown by way of example. Fewer or more channels may be provided, and the channels 132 may be provided in one or more annular rings (two annular rings of channels 132 are shown in FIGS. 6–8). As shown in FIG. 6A, the channels 132 can be replaced by elongated or oval channels 152, which are distributed around the periphery of the diverging discharge section 128 of the device. The channels 152 of FIG. 6A can be increased or reduced in number, depending upon the application.

As shown in FIG. 8, the diverging discharge section 128 can be connected to a conduit 140 which is of predetermined length, depending upon the types of fluids, pressures, velocity, etc., to provide further combining of the primary and secondary fluids into one another, as the fluids pass through elongated conduit 140. Due to the back pressure provided at the utilization apparatus (not shown) at the remote end of conduit 140, the combined fluid flowing through conduit 140 is under pressure and therefore, as it passes through the conduit 140, the secondary and primary fluids become more and more dissolved in one another until a desired point, such as the saturation point, is reached. After a maximum saturation point of the fluids is reached, the fluids will cease dissolving into one another, and the excess will remain as bubbles or particles, etc., and will be carried along within the fluid.

The internal diameter of conduit 140 can be sized to influence the amount of back pressure developed. For example, enlarging the diameter of conduit 140 will decrease the back pressure developed in the conduit 140, and vice versa. It is, in some cases, an advantage to add or reduce an amount of back pressure in conduit 140 in order to regulate the dynamics of the fluid flows through the device. The amount of back pressure introduced to the flow will influence the turbulence, velocity, torroidal vortices, dissolving capabilities, bubble size, etc., as well as the volumes of each of the fluids flowing through the device. Back pressure can be adjusted using the back pressure adjustment device of FIGS. 14 and 14A, which is described hereinafter.

Referring to FIGS. 6–8, it is preferable that the diameter of the input conduit 141 be substantially the same as the diameter of the elongated output conduit 140. However, depending upon the specific application, the respective diameters may be different. The output conduit 140 can be used with any of the embodiments of the invention, as should be apparent.

FIG. 8A shows a modification where grooves 129 are formed on the inside wall of discharge section 128 to increase turbulence and the production to torroidal vortices, which may improve the mixing effect.

FIGS. 9A–9F show embodiments similar to that of FIGS. 6–8, but wherein the device is formed in different combinations of component elements.

Figure 9F:
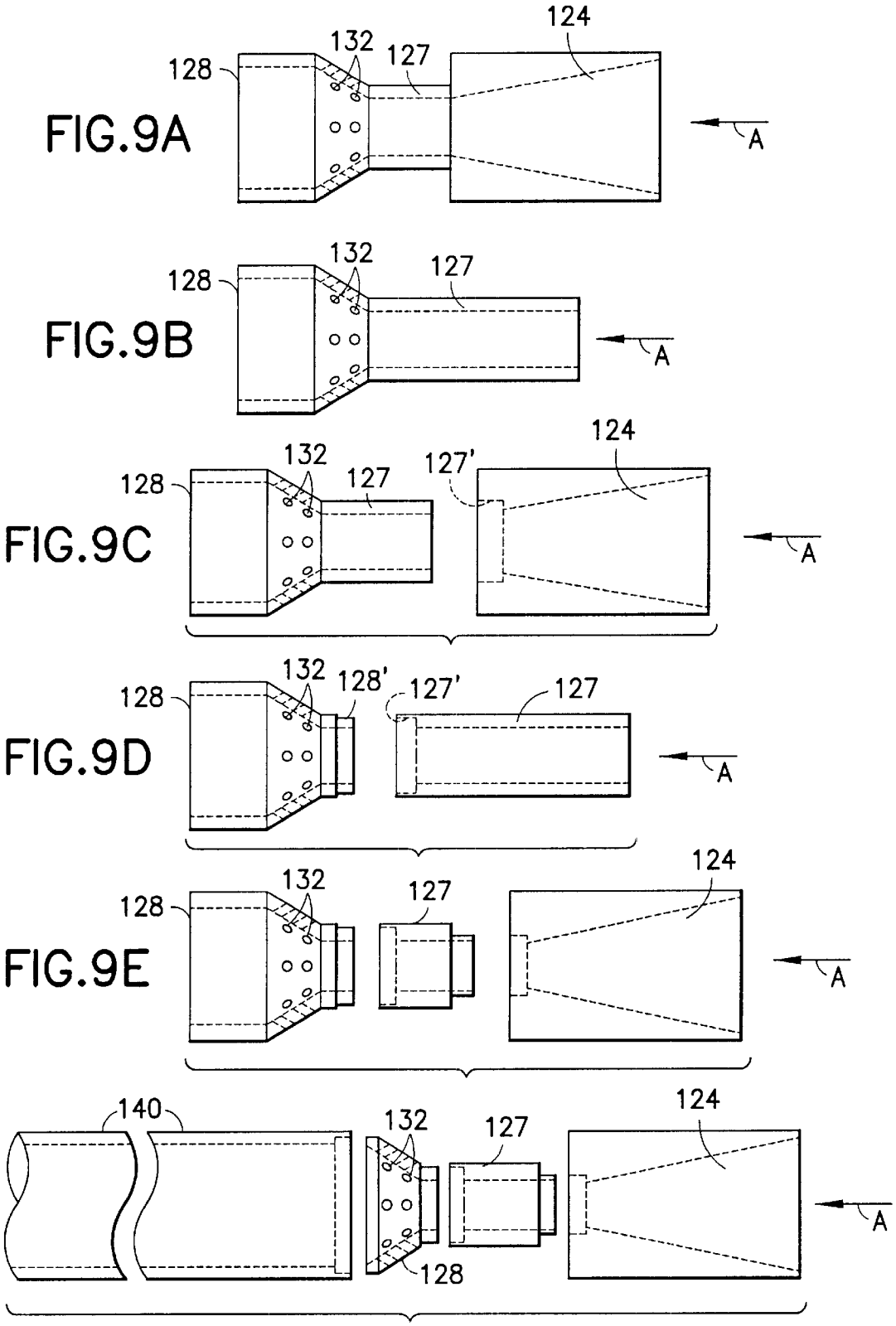

FIG. 9A shows a one-piece structure rather than a two-piece structure as shown in FIGS. 6–8. The embodiment of FIG. 9A can be machined from a composite plastic material (the materials used in the embodiments earlier described) from a single member. Alternatively, the main device can be molded and the channels 132 can be machined, for example by drilling. Other fabrication techniques could be used. The same reference numerals are used throughout FIGS. 9A–9F to designate the same or similar elements. The parts shown in FIGS. 9A–9F may be made of a composite plastic material or any other suitable plastic or metal material.

FIG. 9B illustrates the embodiment of FIGS. 6–8, but without a converging inlet section 124. The embodiment of FIG. 9B is useful when the incoming primary fluid flow is of sufficient velocity and pressure that the converging portion 124 is not necessary to increase the pressure further. The embodiment of FIG. 9B, as well as all of the other disclosed embodiments of the invention, can be used with an output conduit 140 as shown in FIG. 8, as desired. In the device of FIG. 9B, the throat section and the discharge section 128 are made as one piece.

FIG. 9C shows a two-piece structure wherein the throat section 127 and the discharge section 128 are fabricated from a single piece, and the primary entry section 124 is fabricated from a second piece. The pieces are assembled by inserting the end of the throat section 127 into the bore 127' in the input section 124. The two sections can be press-fit together in a liquid-tight manner, or may be adhered together using adhesives.

The embodiment of FIG. 9D is similar to that of FIG. 9B, but is a two-piece structure rather than a one-piece structure as shown in FIG. 9B. In FIG. 9D, the throat section is assembled onto a boss 128' of the discharge section which is inserted into opening 127' at the end of the throat section. As with the embodiment of FIG. 9C, the parts can be press-fit together in a fluid-tight manner, or may be adhered, for example by adhesives.

FIG. 9E shows a similar embodiment, but wherein the device is a three-piece structure. The throat section 127 is connected to the discharge section 128 and to the entry section 124, in the manner described above.

FIG. 9F shows an embodiment similar to that of FIG. 9E, but further including an elongated conduit 140 at the discharge end thereof.

An advantage of the multi-part embodiments of FIGS. 9C–9F is that the specific device for a specific embodiment can be assembled from standardized parts, thereby facilitating fabrication and facilitating experimentation to arrive at the optimum sized device. Different parts having different diameters and different throat lengths, for example, can be kept in stock for assembly, as desired.

The elongated conduit 140 at the discharge end of the device, as shown in FIG. 9F, is provided to maintain pressure over a predetermined distance after the discharge section 128, to promote further dissolving of the fluids in one another as the fluids pass through the elongated conduit 140. As mentioned above, it should be clear that the elongated conduit 140 can be used with any of the embodiments of the invention previously described or to be described hereinafter.

Figure 10:
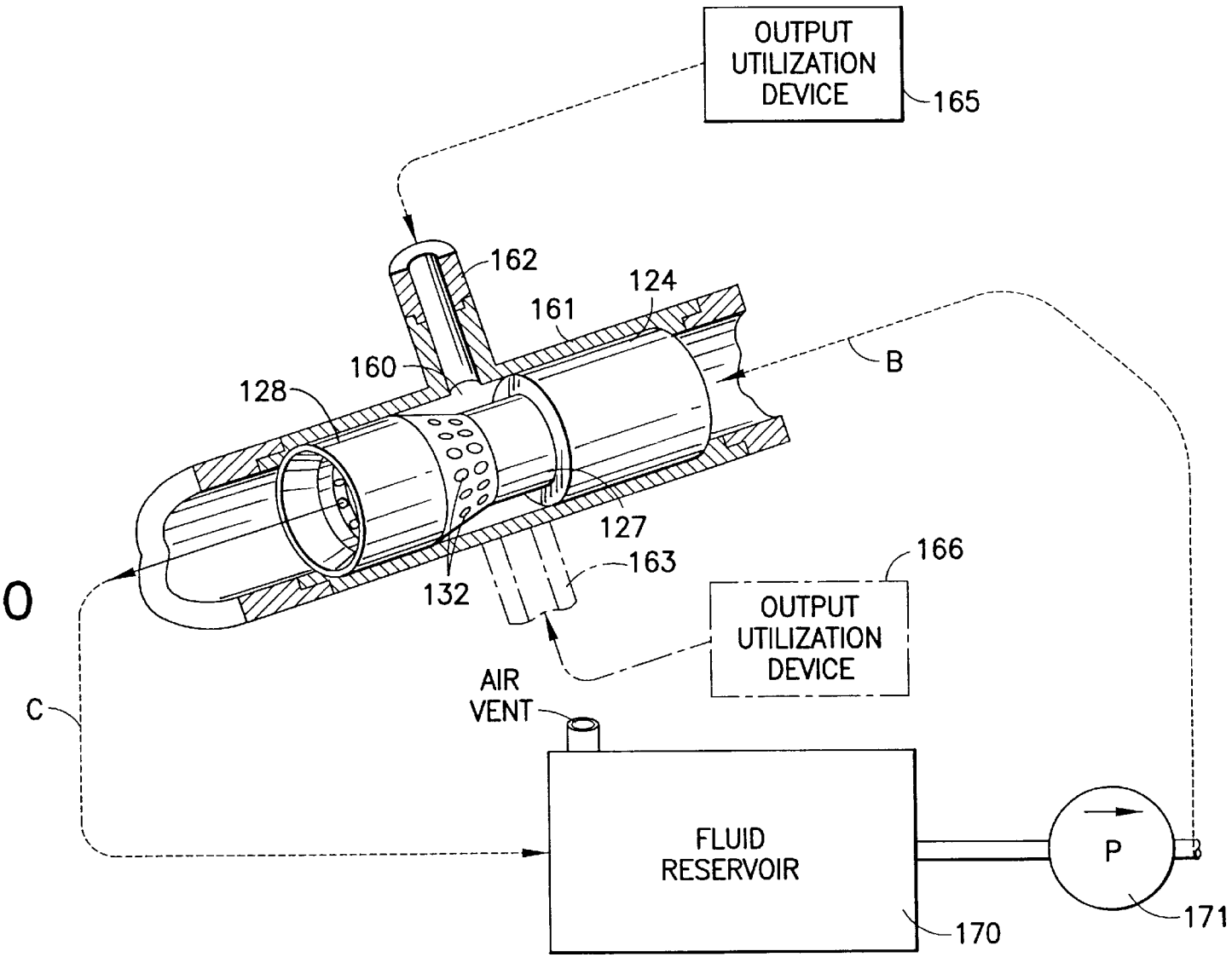
FIG. 10 is a partial exploded cross-sectional view of a vacuum pump using the differential injectors of the present invention.

FIG. 10 shows the embodiment of FIGS. 6 and 7 used as a vacuum pump. The input velocity of the primary fluid B flowing through entry section 124 is sufficient to draw air or other secondary fluid through the channels 132 so as to create a suction effect in the chamber 160 which surrounds a central portion of the mixing device. The chamber 160 is formed by mounting a housing 161, such as a "T", around the device, as shown in FIG. 10. A reduced pressure is created in chamber 160 and results in the device operating as a vacuum pump. The degree of vacuum or reduced pressure is a function of the physical design characteristics of the device, as should be apparent to those of ordinary skill in the art. The housing has a pipe-like fitting 162 which is coupled to an output utilization device 165 to utilize the produced vacuum or reduced pressure in chamber 160. A second fitting 163 may be coupled to a second utilization device 166 to use the vacuum reduced pressure. Liquid from a fluid reservoir 170 is pumped by a pump 171 through a conduit (B) to the injector device, and the output fluid C is returned to the fluid reservoir for re-use. An air vent 172 is provided on the fluid reservoir 170.

Figure 11:
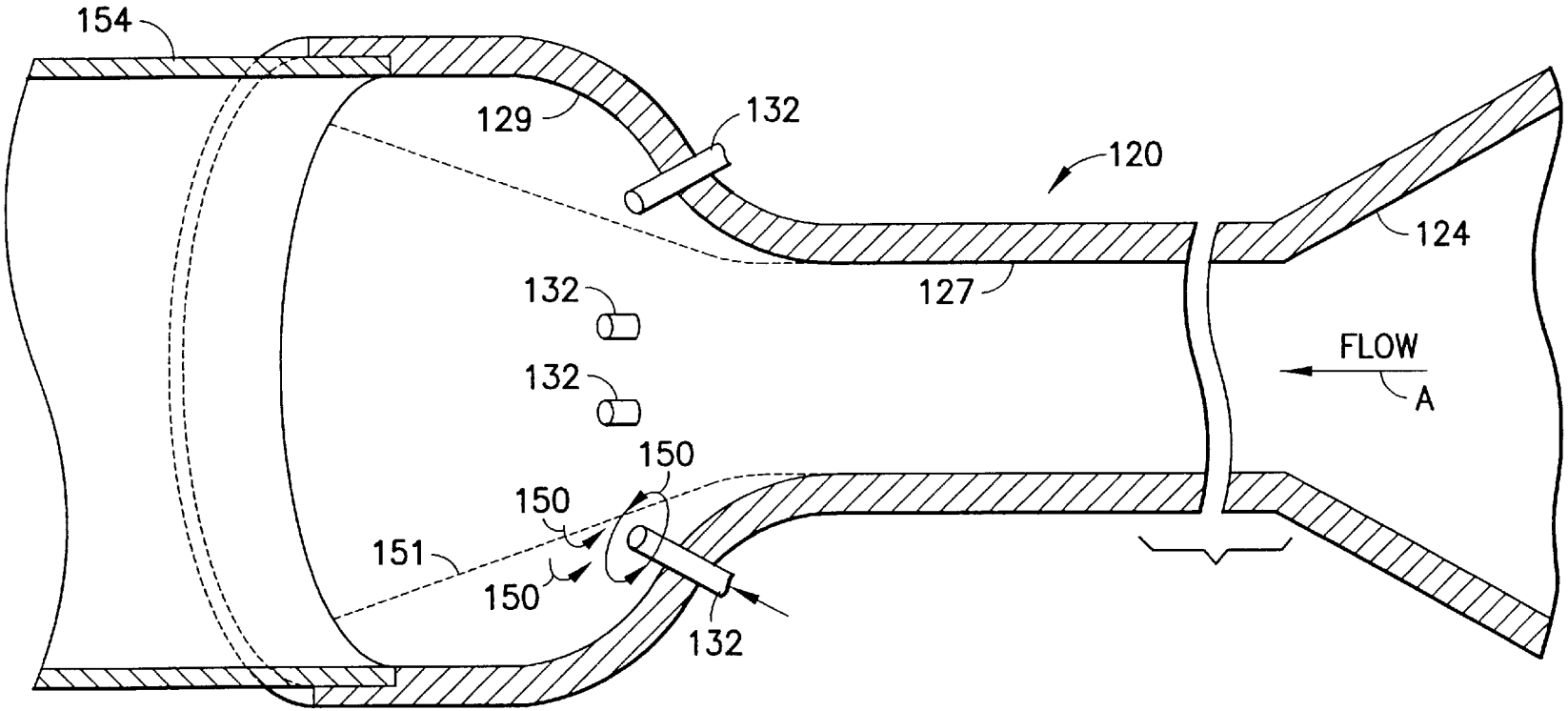
FIG. 11 is an exploded cross-sectional view of still another embodiment of a differential injector according to the present invention.

FIG. 11 shows a differential injector having a venturi 124 for receiving primary fluid flow in the direction of arrow A. The venturi 124 has a throat section 127 and an outwardly diverging bell-shaped exit section 129. Secondary fluid is injected into the inlet ports 132 which may be provided in any desired number around the periphery of the differential injector 120. In the illustrated embodiment, the differential injector is generally round in shape (or of other hollow tubular shape) and four secondary fluid flow injector ports 132 are shown. The opposite half of the device, not seen in the drawings, would include a similar number of secondary fluid flow injection ports.

The secondary fluid flow injection ports 132 penetrate through the wall section of the diverging section 129 of the venturi 124 and discharge secondary fluid into areas of the primary fluid flow in which torroidal vortex centers appear. The vortexes are shown by way of example by arrows 150 in FIG. 6. The vortexes are generated in the vicinity and forward (downstream) of the diverging wall of the diverging section 129, and the main portions thereof appear generally between the diverging wall and the dashed line 151 shown in FIG. 11. A similar phenomenon takes place around the periphery of the round diverging portion 129 of the device of FIG. 11, adjacent the secondary fluid flow injector ports 132.

The differential injector 120 shown in FIG. 11 is connected via an outlet conduit 154 to an outlet utilization device. A conduit such as conduit 140 may be used.

The device of FIG. 11, as well as the previously illustrated devices, operate with fluids as the main or primary flow, and also as the secondary fluid flow, to provide mixing and/or aeration of the fluids flowing through the device. The fluids may be liquid or gaseous. The ports 132 are directed at an angle relative to flow A of no more than about 30 degrees, and preferably less than about 20 degrees so that the secondary fluid flow is generally in the same direction-as the primary fluid flow.

Figure 12:
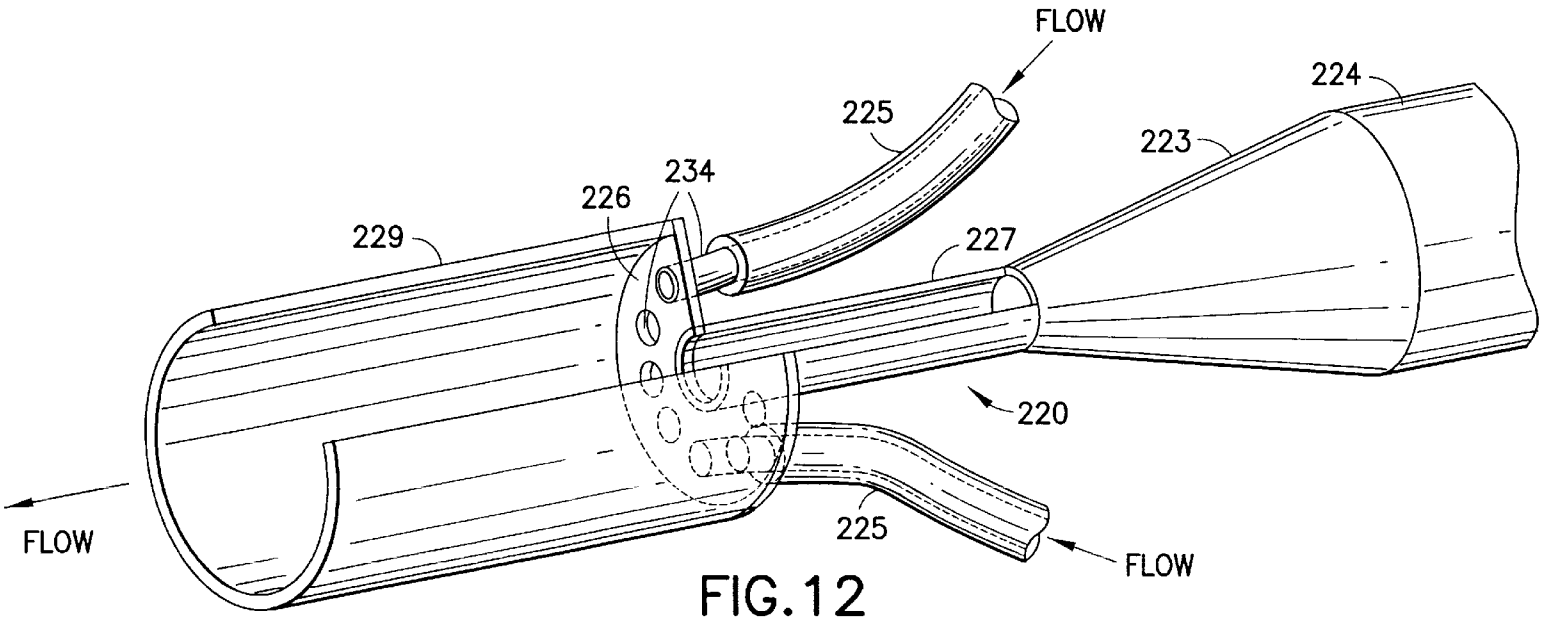
FIG. 12 is a partial cross-sectional view of still another embodiment of a differential injector according to the present invention.

FIG. 12 illustrates another venturi-like device having a tubular opening 224 for receiving a primary fluid flow in the converging section 223, which primary fluid flow is then accelerated in the throat section 227. Secondary flow ports 234 are provided in a wall 226 of the outlet or discharge section 229 of the differential injector 220. The secondary fluid flow inlet ports 234 are connected to a source of secondary fluid by means of conduits 225, as shown, or they can be connected to a manifold surrounding throat section 227, in a manner similar to annular opening 34 in FIG. 5. Preferably, the forward end portions of the injection ports 234 extend into the interior of the throat section 229, as shown in greater detail in FIG. 12A. In FIG. 12A, only one such injection port 234 is shown. Others will extend through the openings shown in FIG. 12A. The ports 234 permit independent control of flow access by providing plugs, valves, flow regulators, pressure regulators, orifices or any other fluid flow control member in series with the ports 234, to control the secondary fluid flow therethrough.

Figure 12B:
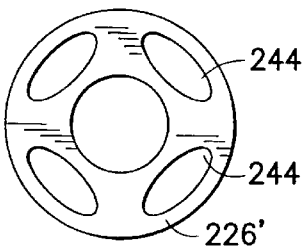
FIGS. 12A and 12B are partial exploded views with respect to modifications of the embodiment of FIG. 12.
Figure 12A:
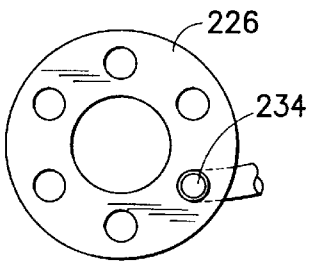

FIG. 12B is similar to FIG. 12A and shows the ports 244 being of an oblong, oval or elliptical shape through plate 226'. The number of ports 244 can vary, depending upon application. It is considered that 4 to 8 such ports 244 are desirable. However, for ease of illustration, only one such port 244 is shown.

Figure 13:
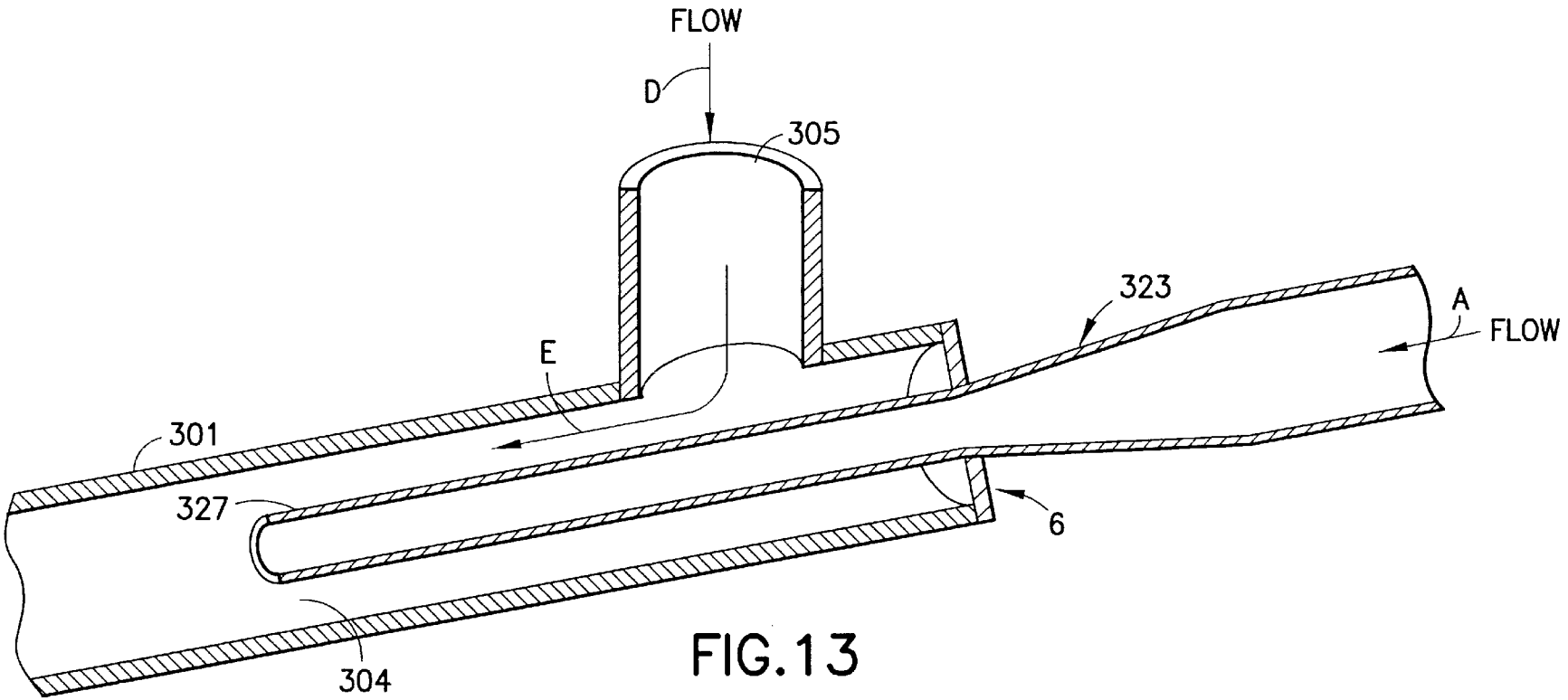
FIG. 13 is a cross-sectional view of still another embodiment of a differential injector according to the present invention.

FIG. 13 illustrates still another embodiment of the invention having a converging inlet section 323 which converges to an elongated throat section 327, and through which a primary fluid flows in the direction of arrow A. A housing 301 is provided around at least a portion of the throat section 327 of the device. The housing 301 has an inlet port 305 through which secondary fluid enters in the direction of arrow D. In this embodiment, no individual secondary ports are provided for the secondary fluid. The secondary fluid flows in the direction of arrow D and then in the direction of arrow E and then enters into the main fluid flow in the vicinity of area discharge 304. When the primary fluid exits the throat section 327 in the vicinity of area 304, turbulence is created and a suction effect is created to suck the secondary fluid flowing in the direction of arrow E into the primary fluid flow. An important feature of the embodiment of FIG. 13 is that by varying the location of where the primary fluid is introduced into the area 304, the dynamics of the fluid flows can be changed.

As seen in FIG. 13, the device of FIG. 13 is circular and only half of the circular configuration is shown in cross-section. Hollow shapes other than circular can be used. The embodiment of FIG. 13 provides substantially concentric annular secondary fluid flow through the annular secondary flow inlet.

Figure 14:
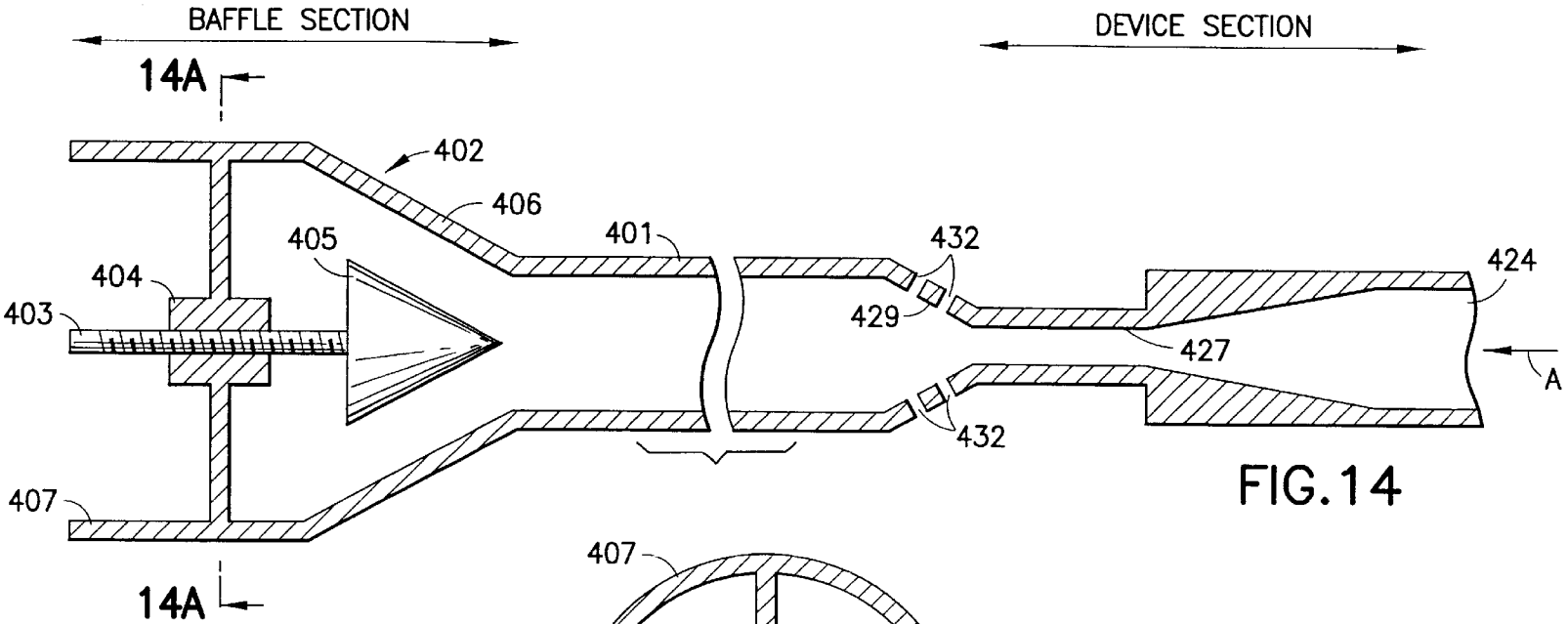
FIG. 14 is a cross-sectional view of still another embodiment of a differential injector according to the present invention, with a back pressure regulating device.

FIG. 14 illustrates still another embodiment of the invention wherein primary fluid flows in the direction of arrow A into the entrance of a venturi-type opening section 424, and then through a throat section 427, and then out through a diverging discharge section 429. Secondary fluid enters through the channels 432. In the illustrated embodiment, the secondary fluid is air. However, secondary fluid conduits can be provided similar to conduits 234, 225 in FIG. 12, to feed any desired fluid as secondary fluid into channels 432. The secondary fluid entering though ports or openings 432 enters into a turbulent portion of the diverging primary flow in the vicinity of discharge section wall 429, and the turbulence creates mixing and aeration of the primary fluid flowing through the device. The resultant combined fluid flow passes through conduit 401 (which may be any desired length) to a baffle section 402 which is provided to create a back pressure to vary the mixing conditions. The back pressure providing device in the baffle section comprises an elongated screw member 403 which is threadably mounted in a fixed member 404. The fixed member 404 is shown in greater detail in FIG. 14A which is a cross-section along line 14A—14A in FIG. 14. The fixed support member 404 is designed to minimize obstructing the flow through conduit 407. A cone-shaped baffle member 405 is provided at the forward end of the screw 403 so as to cooperate with the inclined walls 406 of the baffle section to provide baffling or back pressure against fluid flow. As the baffle member 405 is moved toward the right in FIG. 14, the space between the baffle member 405 and the inclined wall 406 reduces, thereby increasing the back pressure. The opposite effect occurs when the baffle member 405 is moved to the left in FIG. 14. The change in back pressure changes the operating conditions of the device and in some cases can convert the device from being thought of as a mixer to an aerator, or vice versa. The fluid exits via conduit 407. The control of back pressure also enables control of dissolving of the primary and secondary fluids in one another as they flow under pressure in conduit 401.

In all of the embodiments of the present invention, primary fluid flow, such as water flow, may, for example, be at a rate of about 1,000 to about 2,000 feet per minute, and the secondary fluid flow, such as air flow, can be provided without any applied pressure. Merely ambient pressure and the suction effect as the primary fluid flow creates suction at the outlet or discharge area after the throat section, is sufficient to provide the mixing and/or aeration and/or dissolving effects. Increasing the pressure of the secondary fluid flow can, in some cases, increase efficiency. For all of the devices shown and/or described herein, the elongated exit conduit, such as conduits 140, 401, 407 can be used and can be as long as desired to produce desired saturation (dissolving) of fluids. Lengths such as 1 foot to 100 feet could be used, or from 1 to 20 feet or 1 to 30 feet may be preferable, in some instances.

Conduit 407 in FIG. 14 can be of a diameter significantly larger than conduit 401, which would allow for a decrease of back pressure, and utilizing the adjustable baffle member 405, in this case, would allow for fine tuning of pressures in the system. In some applications, conduit 407 may be very short.

Figure 14A:
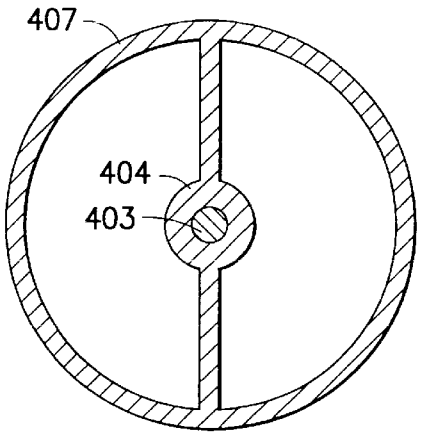

A back pressure controlling device such as that shown in FIGS. 14 and 14A, or a back pressure controlling device such as a baffle, valve, orifice or any other type of restriction device, or a properly dimensioned conduit, can be provided for any of the embodiments shown and/or described herein to control back pressure in the respective systems.

It is to be understood that the present invention is not limited to the embodiments described above, but encompasses any and all embodiments within the scope of the following claims.

What is claimed is:

1. A differential injector for mixing in a flow device comprising:

a substantially cylindrical fluid flow body having a venturi disposed therein and first and second wall portions, said venturi being disposed and aligned concentrically with said substantially cylindrical fluid flow body, for providing primary fluid flow through said venturi, the venturi having an inlet port, a throat portion and an outlet port;

a secondary fluid port for supplying a secondary fluid for mixing with the primary fluid, said secondary fluid port being disposed within said first wall portion of the substantially cylindrical fluid flow body, for delivering the secondary fluid to a plurality of flow channels, said plurality of flow channels being disposed within said second wall portion of the substantially cylindrical fluid flow body, said plurality of flow channels supplying the secondary fluid at a point which is downstream of the throat portion, said plurality of flow channels being aligned and including first and second groups of flow channels, the first group of flow channels being disposed between the second group of flow channels and an interior surface segment of the second wall portion of said substantially cylindrical fluid flow body, the first and second groups of flow channels terminating at respective first and second outlet ports within the substantially cylindrical fluid flow body, the first and second outlet ports having a segment of the interior surface segment of the second wall portion disposed therebetween, the interior surface segment of the second wall portion including at least one surface irregularity to increase turbulence and the production of torroidal vortices to improve mixing of the primary fluid and the secondary fluid.

2. The differential injector for mixing in a flow device according to claim 1, wherein said substantially cylindrical fluid flow body further comprises an annular cavity disposed within a central portion of said flow device and concentric thereto.

3. The differential injector for mixing in a flow device according to claim 2, wherein said cavity is dimensioned, configured and arranged to be in fluid communication with the secondary fluid port.

4. The differential injector for mixing in a flow device according to claim 2, wherein said cavity is dimensioned, configured and arranged to be in fluid communication with the secondary fluid port and said plurality of channels.

5. The differential injector for mixing in a flow device according to claim 1, wherein said plurality of channels are disposed within said second wall portion peripheral to said venturi.

6. The differential injector for mixing in a flow device according to claim 1, wherein said substantially cylindrical fluid flow body is made of a composite plastic material.

7. The differential injector for mixing in a flow device according to claim 1, wherein said flow channels are integrally formed through a connecting wall.

8. The differential injector for mixing in a flow device according to claim 7, wherein said integrally formed flow channels are also integrally formed at least in a portion of said second wall portion.

9. The differential injector of claim 1, wherein the at least one surface irregularity comprises a step.

10. The differential injector of claim 1, wherein the first and second groups of outlet ports are annularly disposed.

11. The differential injector of claim 1, further comprising grooves on an interior surface of the second wall portion downstream of the first and second outlet ports to create additional turbulence and torroidal vortices to improve mixing of, and the resulting actions upon, the primary fluid and the secondary fluid.

12. A mixing device for mixing two fluids, comprising:

a first section having an inner passage defining a primary fluid flow path;

a second section having an inner passage of larger cross-sectional area than the inner passage of said first section, at least a portion of said second section being downstream of a downstream end of said first section;

a third section connecting the first and second sections, said third section having a connecting wall connecting the first and second sections;

a secondary fluid injection area in the vicinity of said downstream end of said first section; and a plurality of secondary fluid injection channels formed in at least a portion of said connecting wall, said secondary fluid injection channels being integrally formed in said connecting wall and exiting at an inner surface of said connecting wall such that said secondary fluid injection area is adjacent an inner surface of said connecting wall, wherein said plurality of secondary fluid injection channels include first and second groups of flow channels, the first group of flow channels being disposed between the second group of flow channels and the interior surface of said connecting wall, the first and second groups of flow channels terminating at respective first and second outlet ports, the first and second outlet ports having a segment of connecting wall disposed therebetween, the segment of connecting wall including at least one surface irregularity to increase turbulence and the production of torroidal vortices to improve mixing of the primary fluid and the secondary fluid.

13. The mixing device of claim 12, wherein said channels are integrally formed through said connecting wall and extend at an angle of about 0 to about 25° relative to the direction of primary fluid flow.

14. The mixing device of claim 13, wherein said angle is from about 15° to about 25.

15. The mixing device of claim 14, wherein said angle is about 20°.

16. The mixing device of claim 12, wherein said connecting wall is inclined outwardly and in the direction of primary fluid flow from said downstream end of said first section to said second section.

17. The mixing device of claim 12, wherein said secondary fluid injection area is located in said vicinity of said downstream end of said first section, and downstream of said downstream end of said first section.

18. The mixing device of claim 12, further comprising an elongated conduit coupled to said second section for passing mixed primary and secondary fluids therethrough and for causing said primary and secondary fluids to dissolve in one another.

19. The mixing device of claim 18, wherein said conduit has a length which is between about 1 foot and about 100 feet.

20. The mixing device of claim 18, wherein said conduit has a length which is between about 1 foot and about 50 feet.

21. The mixing device of claim 18, wherein said conduit has a length which is between about 1 foot and about 30 feet.

22. The mixing device of claim 18, wherein said conduit has a length which is between about 1 foot and about 10 feet.

23. The mixing device of claim 12, further comprising a back pressure adjusting device coupled to said second section for adjusting the back pressure on the primary and secondary fluids in said second section.

24. The mixing device of claim 23, wherein said back pressure reducing device comprises a conduit and a blocking or flow resistance providing member in said conduit to provide space between said blocking or flow resistance providing member and inner walls of said conduit.

25. The mixing device of claim 24, wherein said blocking or flow resistance providing member is adjustably mounted in said conduit for varying the spacing between said blocking or flow resistance providing member and the inner walls of said conduit.

26. The mixing device of claim 25, wherein said conduit has inclined walls in the vicinity of said blocking member, and said blocking member is movable in a direction so as to vary the distance between said blocking member and said inclined walls, thereby varying the back pressure.

27. The mixing device of claim 26, wherein said blocking member has an elongated screw member coupled thereto, and further comprising a fixed threaded member for engaging said elongated screw member such that by turning said elongated screw member, the position of said blocking member is varied in said conduit.

28. The mixing device of claim 12, wherein the at least one surface irregularity comprises a step.

29. The mixing device of claim 12, wherein the first and second groups of outlet ports are annularly disposed.

30. The mixing device of claim 12, further comprising grooves on an interior surface of the second section downstream of the first and second outlet ports to create additional turbulence and torroidal vortices to improve mixing of, and the resulting actions upon, the primary fluid and the secondary fluid.

31. A differential injector for mixing in a flow device comprising:

a tubular fluid flow body having walls defining a venturi which is disposed in said tubular fluid flow body, and providing primary fluid flow through said venturi, said tubular fluid flow body having wall portions defining an inlet port of said venturi for receiving the primary fluid flow and an outlet port of said venturi, the venturi having a throat portion; and a secondary fluid port for supplying at least one secondary fluid for mixing with the primary fluid, said secondary fluid port delivering the secondary fluid to secondary flow channels, said secondary flow channels being disposed within a wall portion of said tubular fluid flow body, and said secondary flow channels opening in the vicinity of said outlet port of said venturi for providing secondary fluid into the primary fluid flow, said secondary flow channels supply the secondary fluid at a point which is downstream of the throat portion, and including first and second groups of flow channels, the first group of flow channels being disposed between the second group of flow channels and an interior surface of the tubular fluid flow body, the first and second groups of flow channels terminating at respective first and second outlet ports within the tubular fluid flow body, the first and second outlet ports having a segment of the interior surface of the tubular fluid flow body disposed therebetween, the segment of the interior surface including at least one surface irregularity to increase turbulence and the production of torroidal vortices to improve mixing of the primary fluid and the secondary fluid.

32. The differential injector for mixing in a flow device according to claim 31, wherein said tubular fluid flow body is substantially cylindrical, and further comprises an annular cavity disposed within a central portion of said tubular fluid flow body and concentric thereto.

33. The differential injector for mixing in a flow device according to claim 31, wherein said tubular flow body is made of a composite plastic material.

34. The differential injector for mixing in a flow device according to claim 31, wherein said channels are integrally formed through said wall portion of said tubular fluid flow body, and extend at an angle of about 0 to about 25° relative to the direction of primary fluid flow.

35. The differential injector for mixing in a flow device according to claim 34, wherein said angle is from about 1520 to about 25°.

36. The differential injector of claim 31, wherein the at least one surface irregularity comprises a step.

37. The differential injector of claim 31, wherein the first and second groups of outlet ports are annularly disposed.

38. The differential injector of claim 31, further comprising grooves on an interior surface of the tubular fluid flow body downstream of the first and second outlet ports to create additional turbulence and torroidal vortices to improve mixing of, and the resulting actions upon, the primary fluid and the secondary fluid.

39. A differential injector for creating a vacuum condition in a chamber, comprising:

a tubular fluid flow body having walls defining a venturi which is disposed in said tubular fluid flow body, and providing primary fluid flow through said venturi, said tubular fluid flow body having wall portions defining an inlet port of said venturi for receiving the primary fluid flow, a throat portion and an outlet port of said venturi;

a secondary fluid port in communication with the primary fluid flowing through said venturi, said secondary fluid port delivering secondary fluid to a secondary flow channels, said secondary flow channels being disposed within a wall portion of said tubular fluid flow body, and said secondary flow channels providing secondary fluid by injection into the outlet port area of said venturi downstream of the throat portion of said venturi; and a housing surrounding said secondary fluid port and at least partly defining said chamber in which at least a partial vacuum is formed responsive to delivering of secondary fluid from said housing to said outlet port area via said channels, wherein said secondary flow channels include first and second groups of flow channels, the first group of flow channels being disposed between the second group of flow channels and an interior surface of the tubular fluid flow body, the first and second groups of flow channels terminating at respective first and second outlet ports within the tubular fluid flow body, the first and second outlet ports having a segment of the interior surface of the tubular fluid flow body disposed therebetween, the segment of the interior surface including at least one surface irregularity to increase turbulence and the production of torroidal vortices to improve mixing of the primary fluid and the secondary fluid.

40. The differential injector for creating a vacuum condition in a chamber according to claim 39, wherein said tubular fluid flow body is substantially cylindrical, and wherein said secondary fluid port comprises an annular cavity disposed within a central portion of said tubular fluid flow body and concentric thereto.

41. The differential injector for creating a vacuum condition in a chamber according to claim 40, wherein said tubular flow body is made of a composite plastic material.

42. The differential injector for creating a vacuum condition in a chamber according to claim 39, wherein said channels are integrally formed through said wall portion of said tubular fluid flow body, and extend at an angle of about 0 to about 25° relative to the direction of primary fluid flow.

43. The differential injector for creating a vacuum condition in a chamber according to claim 42, wherein said angle is from about 15° to about 25°.

44. The differential injector for creating a vacuum condition in a chamber according to claim 43, wherein said angle is about 20°.

45. The differential injector of claim 39, wherein the at least one surface irregularity comprises a step.

46. The differential injector of claim 39, wherein the first and second groups of outlet ports are annularly disposed.

47. The differential injector of claim 39, further comprising grooves on an interior surface of the tubular fluid flow body downstream of the first and second outlet ports to create additional turbulence and torroidal vortices to improve mixing of, and the resulting actions upon, the primary fluid and the secondary fluid.

48. A device for creating a vacuum condition in a chamber, comprising:

a first section having an inner passage defining a primary fluid flow path;

a second section having an inner passage of larger cross-sectional area than the inner passage of said first section, at least a portion of said second section being downstream of a downstream end of said first section;

a third section connected between the first and second sections, said third section having a connecting wall connecting the first and second sections;

a secondary fluid injection area in the vicinity of said downstream end of said first section;

a plurality of secondary fluid injection channels formed in at least a portion of said connecting wall, said secondary fluid injection channels being integrally formed in said connecting wall and exiting at an inner surface of said connecting wall such that said secondary fluid injection area is adjacent an inner surface of said connecting wall; and a housing surrounding at least a portion of at least one of said second and third sections and through which said secondary fluid passes to said injection channels responsive to the flow of primary fluid in said primary fluid flow path, said housing at least partly defining said chamber and in which at least a partial vacuum is formed responsive to delivering of secondary fluid from said housing to said injection area via said channels, wherein said plurality of secondary fluid injection channels include first and second groups of flow channels, the first group of flow channels being disposed between the second group of flow channels and the interior surface of said connecting wall, the first and second groups of flow channels terminating at respective first and second outlet ports, the first and second outlet ports having a segment of the connecting wall disposed therebetween, the segment of the connecting wall including at least one surface irregularity to increase turbulence and the production of torroidal vortices to improve mixing of the primary fluid and the secondary fluid.

49. The device of claim 48, wherein said secondary fluid injection channels extend at least said connecting wall in generally the same direction as the direction of said primary fluid flow path.

50. The device of claim 49, wherein said channels are integrally formed through said connecting wall and extend at an angle of about 0 to abut 25° relative to the direction of primary fluid flow.

51. The device of claim 50, wherein said angle is about 25°.

52. The device of claim 51, wherein said angle is about 20°.

53. The device of claim 48, wherein said connecting wall is inclined outwardly and in the direction of primary fluid flow from said downstream end of said first section to said second section.

54. The device of claim 48, wherein said secondary fluid injection area is located in said vicinity of said downstream end of said first section, and downstream of said downstream end of said first section.

55. The device of claim 48, wherein the at least one surface irregularity comprises a step.

56. The device of claim 48, wherein the first and second groups of outlet ports are annularly disposed.

57. The device of claim 48, further comprising grooves on an interior surface of the second section downstream of the first and second outlet ports to create additional turbulence and torroidal vortices to improve mixing of, and the resulting actions upon, the primary fluid and the secondary fluid.

* * * * *